US006679502B1

(12) United States Patent
Leimer

(10) Patent No.: US 6,679,502 B1
(45) Date of Patent: Jan. 20, 2004

(54) VALVE STEM SEAL ASSEMBLY WITH VALVE GUIDE RETAINER

(75) Inventor: Mark Alan Leimer, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/942,020

(22) Filed: Aug. 28, 2001

(51) Int. Cl.[7] ..... F02F 11/00
(52) U.S. Cl. ..... 277/502; 123/188.04
(58) Field of Search ..... 277/359, 360, 277/502, 551; 285/319; 123/188.8, 186.8, 188.04, 188.9

(56) References Cited

U.S. PATENT DOCUMENTS

| | | | | |
|---|---|---|---|---|
| 1,481,562 A | | 1/1924 | Rowe | |
| 3,326,562 A | | 6/1967 | Deuring | |
| 3,498,621 A | * | 3/1970 | Wilson | 277/502 |
| 3,577,972 A | * | 5/1971 | Moray | 123/188.6 |
| 3,699,942 A | * | 10/1972 | Moray | 123/188.6 |
| 4,198,030 A | * | 4/1980 | Jackson et al. | 251/61.5 |
| 4,531,483 A | | 7/1985 | Vossieck et al. | |
| 4,811,704 A | * | 3/1989 | Boehmer et al. | 123/188.6 |
| 4,811,960 A | | 3/1989 | Stritzke et al. | |
| 5,046,463 A | | 9/1991 | Worsley | |
| 5,072,950 A | | 12/1991 | Littleproud et al. | |
| 5,553,869 A | * | 9/1996 | Stamback | 123/188.6 |
| 5,992,903 A | * | 11/1999 | Bartholomew | 285/319 |
| 6,116,837 A | * | 9/2000 | Suhle | 411/508 |
| 6,123,054 A | | 9/2000 | Netzer | |
| 6,230,679 B1 | | 5/2001 | Hegernier et al. | |
| 6,244,235 B1 | * | 6/2001 | Hegemier et al. | 123/188.6 |
| 6,516,769 B2 | | 2/2003 | McArthy | |

FOREIGN PATENT DOCUMENTS

| | | |
|---|---|---|
| EP | 392893 A1 | 10/1990 |
| EP | 405750 A1 | 2/1991 |
| EP | 750097 A1 | 12/1996 |
| EP | 566059 B1 | 9/1997 |

* cited by examiner

*Primary Examiner*—Robert J. Sandy
*Assistant Examiner*—Dinesh Melwani
(74) *Attorney, Agent, or Firm*—Rader, Fishman Grauer PLLC

(57) ABSTRACT

A valve stem seal assembly for an internal combustion engine includes an elastomer seal body and a metal retainer adapted to secure the seal body in place over a valve guide. The cylindrical seal body has an aperture with at least one radially inwardly directed sealing lip adapted to engage a reciprocally movable valve stem to minimize escape of oil lubricant from the engine along a path between the valve guide and stem. The retainer, formed of a spring metal cylindrical body adapted to frictionally retain the seal body at its upper end, contains first and second sets of axially depending resilient fingers at its lower end. The first set of fingers mechanically engages and supports a unique valve guide member within a valve guide aperture of a cylinder head deck, while the second set of fingers supports the seal assembly directly against the head deck under a valve spring.

20 Claims, 2 Drawing Sheets

VALVE STEM SEAL ASSEMBLY WITH VALVE GUIDE RETAINER

BACKGROUND OF THE INVENTION

1. Field of Invention

The present invention relates to valve stem seal assemblies of the type installed over valve stems reciprocally movable within valve guides of internal combustion engines, and more particularly to seal assembly retainers incorporating specially designed retention fingers for securement of such assemblies to valve guides.

2. Description of the Prior Art

Those skilled in the art will appreciate the manner in which intake and exhaust valves are employed in cylinder heads of internal combustion engines. Such valves, supported for reciprocal motion within valve guides, include integral elongated stems extending away from the engine cylinder heads, the ends of the stems typically interacting with rotating overhead cams for cyclic opening and closure of the valves during the combustion cycle against the force of valve return springs. Obviously, in order to permit unobstructed reciprocal movement of the stem in the guide, some mechanical clearance must exist between the valve guide and the moving stem. A plurality of valve stems thus move reciprocally to and from the cylinder head, each within its individual guide. So-called valve stem seal assemblies are used to seal against leakage of oil through a mechanical clearance path between each annular engine valve guide and its associated valve stem.

As is well known, the intake port of a combustion chamber is opened and closed by the reciprocating motion of at least one intake valve, which in turn is driven by the rotary motion of a cam, the latter being affixed to and thus rotatable with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of similar construction, and both include stems integrally affixed to the valves.

In a typical engine, the valve stem seal assembly is fitted over or atop each valve guide, wherein each seal assembly includes a retainer frictionally mounted to an associated valve guide. Each valve stem seal assembly normally has two primary parts: 1) an elastomeric oil seal for controlling leakage of oil between the valve stem and guide as noted, and 2) a structural, usually metallic, cylindrical retainer mounted atop of the valve guide to hold the oil seal in place.

The advantages of using aluminum cylinder heads in small engine applications are already well known to those skilled in the art. However, it is also known that aluminum parts expand more rapidly when heated than do associated steel or cast-iron parts. Thus, apertures in cylinder head decks designed to accommodate the installation of steel or cast-iron valve guides, through which valve stem seals reciprocally move, tend to expand more rapidly than the guides when heated, and to contract more rapidly than the guides when cooled. As a result, it has been difficult to effectively secure valve guides, particularly those formed of steel or cast-iron, in apertures of aluminum cylinder head decks during the entire heating and cooling cycles of such engines.

One solution has been to symmetrically position an internally flanged washer over the aperture of an aluminum cylinder head deck. In such case, the washer has a relatively larger outside diameter than the aperture, and a smaller internal diameter than the aperture through which the guide can be frictionally supported for extension into the aperture. Thus, upon heating of the cylinder head deck, the aperture walls will be able to expand away from the guide without risk of the guide falling into the engine. A more ideal solution, however, would be one that is actually incorporated into the valve stem seal assembly.

The valve stem seal retainer of the present invention addresses the noted guide securement issue, and incorporates a mechanical coupling feature to assure positive retention of the valve guide.

SUMMARY OF THE INVENTION

The invention is a novel valve stem seal and retainer assembly for use in an internal combustion engine. A plurality of such assemblies is contemplated for use in an engine; each is designed to physically secure an engine valve guide in place in a cylinder head aperture that expands and contracts during engine operating cycles. Each cylindrical valve stem seal assembly includes an elastomer seal body having a radially inwardly depending sealing lip adapted for continuous engagement with an associated reciprocally moveable valve stem. The lip is adapted to engage the stem to minimize escape of oil lubricant from the engine along a path between the valve guide and the reciprocally moving valve stem seal.

In the disclosed embodiment, the valve stem seal assembly includes a retainer formed of an annular metal body adapted to frictionally retain the elastomer seal body at its upper end. The lower end of the retainer contains first and second sets of axially concentric depending resilient fingers. The first set of fingers extend radially inwardly to mechanically engage and support a unique valve guide member within the body of the retainer for suspension of the guide within a valve guide aperture of a cylinder head deck. The second set of fingers extend radially outwardly, and are adapted to structurally support the seal assembly against the cylinder head deck under a valve spring situated directly against the fingers, and effective to trap the second set of fingers between the spring and deck.

DETAILED DESCRIPTION OF EMBODIMENTS

Figure 1:
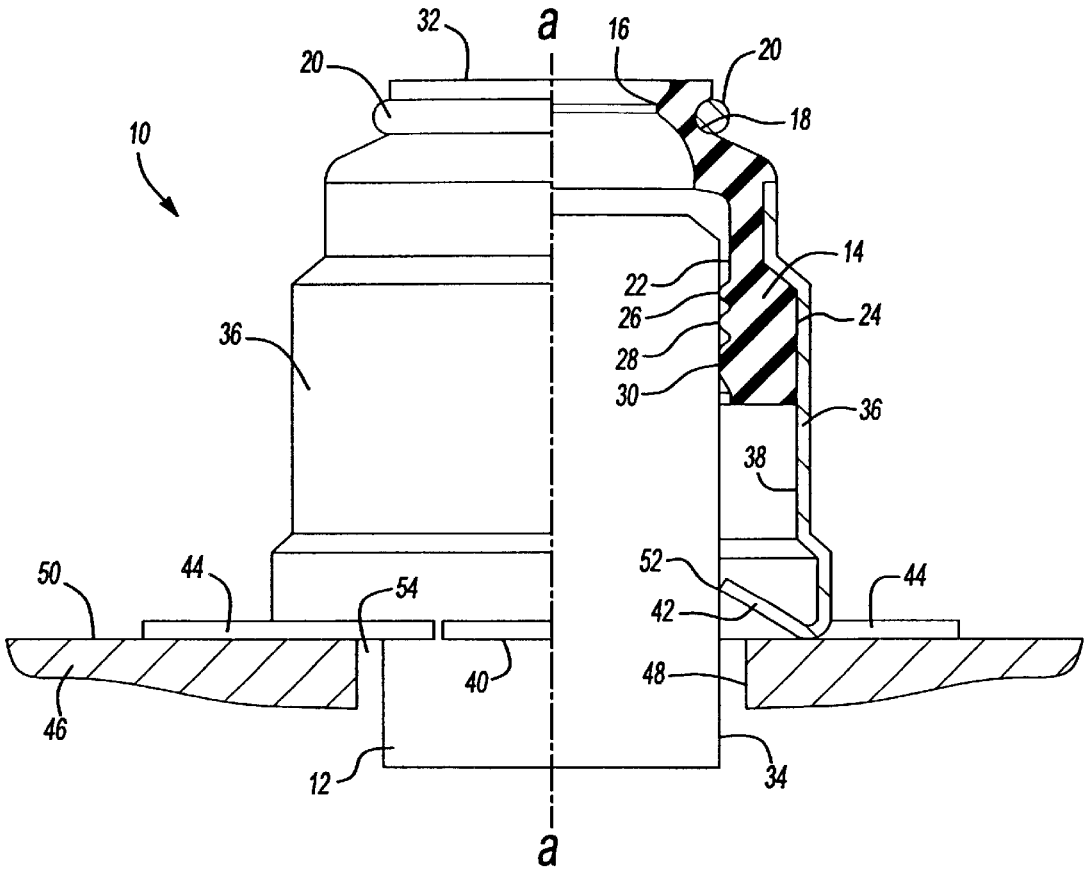
FIG. 1 is a side elevation view, shown in partial cross-section, of one described embodiment of the present invention.

Referring initially to FIG. 1, a valve stem seal assembly 10 is adapted to secure an annular non-self supporting valve guide 12 in position over and through an aperture 48 of a cylinder head deck 46 of an internal combustion engine (not shown). The valve guide 12 is adapted to support reciprocal longitudinal movement of an elongate valve stem (not shown) within the guide 12 along an axis a—a. The valve stem seal assembly 10 includes a resilient jacket body 14 adapted to sealingly engage the valve stem. For this purpose, the jacket body 14 incorporates a circumferentially extending primary interior sealing lip 16, and an exterior groove 18 adapted to receive a metallic retainer wire ring 20. The retainer wire ring 20 is positioned to impart a radial compression force against the resilient sealing lip 16, to in turn force the lip against the reciprocally moving valve stem.

The seal jacket body 14 is generally annular in shape, preferably formed of an elastomeric material, and includes interior and exterior surfaces 22 and 24, respectively. Within its interior surface 22 and adjacent its upper extremity 32, the body 14 includes the noted circumferentially extending interior sealing lip 16 adapted to engage the circumferential exterior surface of the stem for limiting and or otherwise controlling movement of crankcase oil along a mechanical clearance path between the stem and the valve guide 12 for avoiding undesirable escape of oil into the combustion chamber, as will be appreciated by those skilled in the art.

In the embodiment described herein, the valve stem seal assembly 10 further includes a secondary set of sealing lips 26, 28, 30 positioned in a lower circumferential interior surface 22 of the elastomeric seal jacket body 14, as shown. The lips 26, 28, 30 are adapted to frictionally engage the exterior circumferential surface 34 of the valve guide 12 to assure that there is no oil leakage between the interface of the guide 12 and jacket body 14. It will thus be appreciated by those skilled in the art that the primary sealing lip 16 and the secondary sealing lips 26, 28, 30 operate in concert to control oil flows between the valve stem, the guide 12, and the jacket 14.

The disclosed embodiment of the valve stem seal assembly 10 includes a jacket body retainer 36 defined by a cylindrical metal shell, having a stepped cross-section for enhancement of frictional securement of the jacket 14; i.e. the circumferential interior 38 of the retainer 36 is adapted to frictionally secure the seal jacket body 14 in the manner shown.

Figure 2:
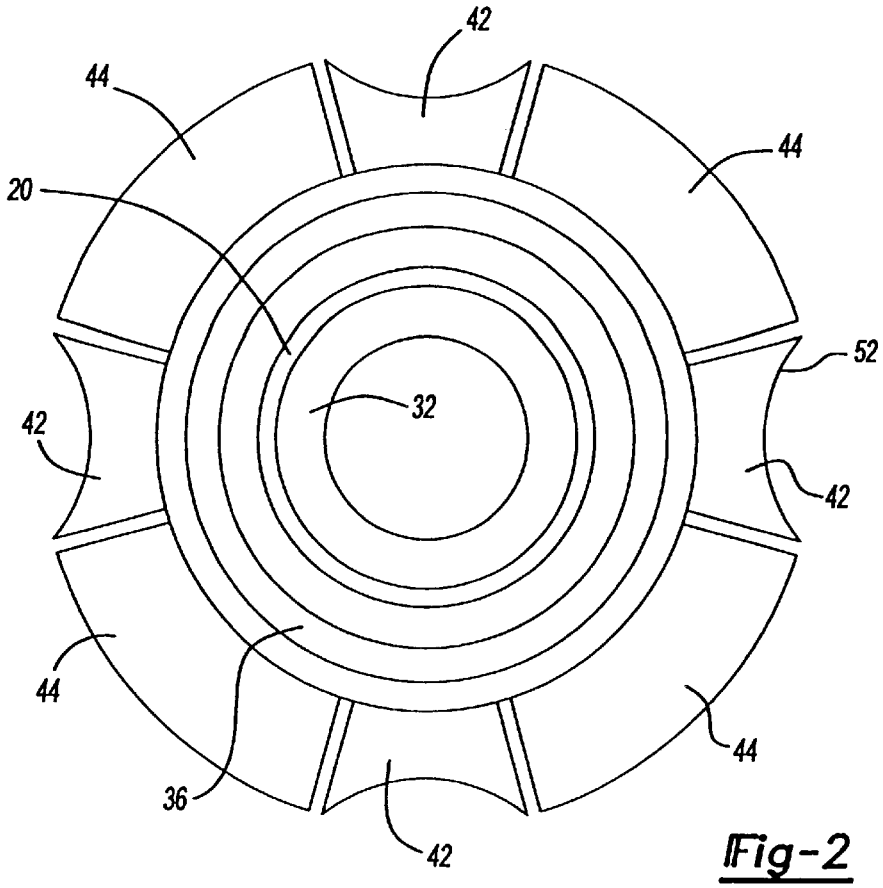
FIG. 2 is a top view of the same embodiment of the present invention, shown prior to having its guide retention fingers bent radially inwardly during its manufacture.
Figure 3:
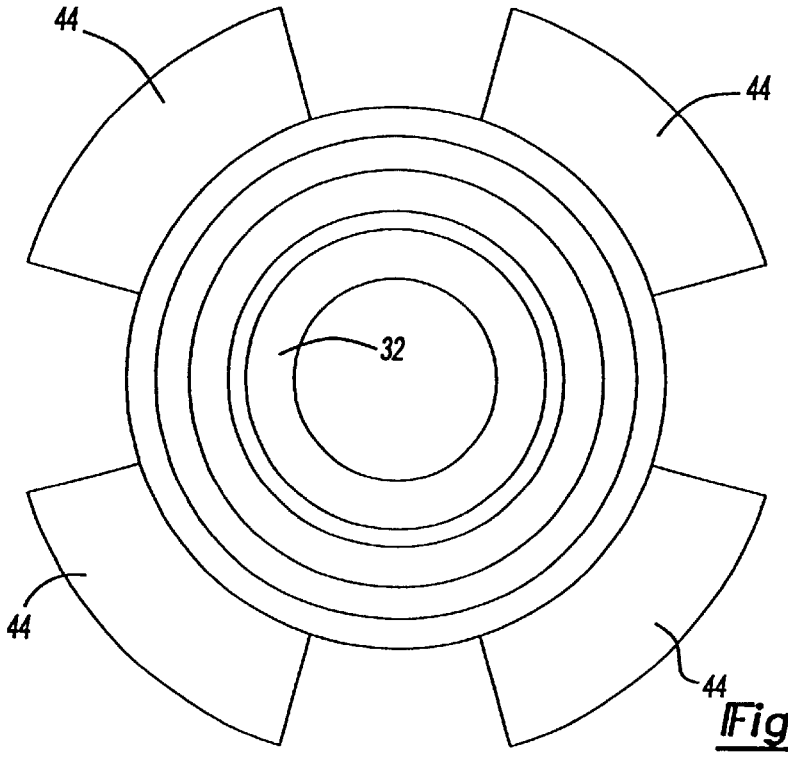
FIG. 3 is a top view of the same embodiment of the present invention, shown after its guide retention fingers have been bent radially inwardly.

Referring now also to FIGS. 2 and 3, the lower extremity 40 of the metal shell retainer 36 includes two sets of fingers 42, 44. The first set of fingers 42 are bent radially inwardly during manufacture of the assembly 10, and includes ends 52 adapted to frictionally engage the exterior circumferential surface 34 of the valve guide 12, as shown in FIG. 1. The fingers 42 are uniformly spaced in regular angular intervals for concentrically positioning the valve guide 12 within the hollow interior 38 of the jacket body retainer 36.

A second set of fingers 44 is flared radially outwardly during manufacture of the assembly 10 for supporting the seal assembly under a valve spring (not shown) as will be appreciated by those skilled in the art. The fingers 44 are also arranged circumferentially, and are generally orthogonal to the axis of the cylindrical body of the retainer. The fingers 44 are particularly adapted to support the assembly 10 atop the deck surface 50, and also operate to avoid scouring of the deck surface 50 by the valve spring under dynamic conditions of engine operation. The fingers 44 are bent radially outwardly for this purpose. In the described embodiment, the fingers 42, 44 are in distinct interleaved sets, bent at least 180 degrees of each other.

It should be noted that the first set of fingers 42 are bent radially inwardly to support the guide member within the retainer body at temperatures approaching normal engine operating temperatures. The aluminum deck 46 (FIG. 1) includes an aperture 48 through which the valve guide 12 passes. The fingers 42 secure the guide 12 reliably in place during and between engine operating cycles; i.e. whenever the temperature of the deck 46 rises above ambient. Under engine operating temperatures, the aperture 48 opens or expands in a manner such that the aperture 48 cannot frictionally support the guide 12; the guide is thus not self-supporting within the cylinder head. Indeed, a gap 54 (shown exaggerated) will exist between the guide 12 and the aperture 48 under engine operating conditions, as shown in FIG. 1.

Upon engine shutdown, the temperature will drop, and the aperture 48 will close against the exterior circumferential surface 34 of the valve guide 12 so as to close the gap 54. Frictional support of the guide 12 will then be established between the circumferential surface 34 of the valve guide 12 and the aperture 48 in the cylinder head deck 46.

As disclosed, the guide member 12 is made of cast iron or steel, and is pressed through the fingers 42 and upwardly into the bottom of the valve seal assembly 10, protruding slightly therefrom as shown to facilitate installation of the coupled assembly 10 and guide 12 into the aluminum cylinder head deck 46. As noted, when the engine cools down, between engine runs, the valve guide is retained within the aperture 48 of the cylinder head deck 46 which, when cooled, effectively provides a shrink-fit connection between the deck and valve guide member.

Finally, one particular aspect of the present invention is inclusion of a scalloped guide contacting edge 52 that defines an inwardly angled extremity of each finger 42. Thus, each arcuate edge is 52 are sized to collectively define an interior diameter approximately equal to the outer diameter of the guide 12. In addition, the fingers 44 are angled slightly axially upwardly (in reference to axis a—a) so as to grip the exterior circumferential surface 34 of the valve guide 12. Those skilled in the art will appreciate that the angled edge 52 is adapted to bite into the surface 34 in a manner so as to avoid any tendency of the guide 12 to slip out of the assembly 10 and to fall into a combustion cylinder.

It is to be understood that the above description is intended to be illustrative, and not limiting. Many embodiments will be apparent to those of skill in the art upon reading the above description. The scope of the invention should be determined, however, not with reference to the above description, but with reference to the appended claims and the full scope of equivalents to which the claims are entitled by law.

What is claimed is:

1. A valve stem seal assembly adapted for installation over an aperture of a cylinder head deck of an internal combustion engine, said assembly including a cylindrical retainer having a longitudinal axis and a lower extremity terminating at a plane and including a first set of fingers having a length extending radially inwardly with respect to said axis to frictionally engage a valve guide, said lower extremity of said cylindrical retainer further including a second set of fingers having a length extending radially outwardly with respect to said axis to engage a cylinder head deck, wherein said second set of fingers are circumferentially interleaved with said first set of fingers, and wherein each set of fingers has a bent portion arranged in said plane.

2. The valve stem seal assembly of claim 1, wherein said first set of fingers have arcuate ends adapted to mechanically engage an exterior cylindrical surface of the valve guide.

3. The valve stem seal assembly of claim 2, wherein said first set of fingers are circumferentially disposed about said axis, and wherein said arcuate ends of each of said first set of fingers are angled to resist disengagement of said valve guide therefrom.

4. The valve stem seal assembly of claim 3, wherein said first set of fingers are angularly spaced to collectively comprise an aperture sized to frictionally engage the exterior surface of said valve guide to thereby retain said valve guide.

5. The valve stem seal assembly of claim 1, wherein said second set of fingers is adapted to receive a valve spring to support said valve spring against said cylinder head deck to avoid scouring of said head deck.

6. The valve stem seal assembly of claim 1, wherein said valve stem seal assembly further comprises a resilient seal jacket comprising a primary sealing lip adapted to engage a valve stem seal, and wherein said jacket further comprises at least one secondary lip adapted for sealingly engaging said valve guide.

7. The valve stem seal assembly of claim 6, wherein said resilient seal jacket is formed of an elastomeric material.

8. A valve stem seal assembly adapted for installation over an aperture of a cylinder head deck of an internal combustion engine, said assembly including a valve guide is positioned over and through said aperture, and a cylindrical retainer adapted for installation over an aperture of a cylinder head deck of an internal combustion engine, said cylindrical retainer having a longitudinal axis and defining an upper extremity adapted to support an annular resilient seal jacket, said cylindrical retainer defining a lower extremity terminating at a plane and including a first set of fingers having a length extending radially inwardly and upwardly with respect to said axis to frictionally engage said valve guide and secure said valve guide to said retainer, said lower extremity of said cylindrical retainer further including a second set of fingers having a length extending radially outwardly and generally orthogonal with respect to said axis to engage a cylinder head deck, and wherein each set of fingers has a bent portion arranged in said plane.

9. The valve stem seal assembly of claim 8, wherein said first set of fingers have arcuate ends adapted to mechanically engage an exterior cylindrical surface of said valve guide.

10. The valve stem seal assembly of claim 9, wherein said first set of fingers are circumferentially disposed about said axis, and wherein said arcuate ends of each of said fingers are angled to resist disengagement of said valve guide therefrom.

11. The valve stem seal assembly of claim 10, wherein said first set of fingers are angularly spaced to collectively comprise an aperture sized to frictionally engage the exterior surface of said valve guide to retain said valve guide.

12. The valve stem seal assembly of claim 8, wherein said second set of fingers is adapted to receive a valve spring to support said valve spring against said cylinder head deck to avoid scouring of said head deck.

13. The valve stem seal assembly of claim 12, wherein said second set of fingers are circumferentially interleaved with said first set of fingers, each finger of said first set of fingers extending radially at least 180 degrees in reverse direction from a next adjacent finger of said second set of fingers.

14. The valve stem seal assembly of claim 8, wherein said cylindrical retainer is formed of a spring metal material, wherein said annular resilient seal jacket comprises a primary sealing lip adapted to engage a valve stem seal, and wherein said annular resilient seal jacket further comprises at least one secondary lip adapted for sealingly engaging said valve guide.

15. The valve stem assembly of claim 8, wherein said annular resilient seal jacket is formed of an elastomeric material.

16. A valve stem seal assembly adapted for installation over an aperture of a cylinder head deck of an internal combustion engine, said assembly including a cylindrical retainer having a longitudinal axis and a lower extremity terminating at a plane and including a first set of fingers having a length extending radially inwardly with respect to said axis to selectively engage a valve guide, said lower extremity of said cylindrical retainer further including a second set of fingers having a length extending radially outwardly with respect to said axis to selectively engage a cylinder head deck, wherein said first set of fingers have arcuate ends adapted to mechanically engage an exterior cylindrical surface of the valve guide, and wherein each set of fingers has a bent portion arranged in said plane.

17. The valve stem seal assembly of claim 16, wherein said second set of fingers are circumferentially interleaved with said first set of fingers.

18. The valve stem seal assembly of claim 16, wherein said arcuate ends of each of said first set of fingers are angled with respect to said axis, and wherein said second set of fingers are generally orthogonal with respect to said axis.

19. The valve stem seal assembly according to claim 1, wherein said first set of fingers includes a scalloped guide contacting edge that defines an inwardly angled extremity of each finger.

20. The valve stem seal assembly according to claim 8, wherein said first set of fingers includes a scalloped guide contacting edge that defines an inwardly angled extremity of each finger.

* * * * *